US008973906B2

(12) United States Patent
Klingenburg et al.

(10) Patent No.: US 8,973,906 B2
(45) Date of Patent: Mar. 10, 2015

(54) DEVICE FOR CONDITIONING AN AIR FLOW

(75) Inventors: Hans Klingenburg, Essen (DE); Peter Braeutigam, Bochum (DE); Hans Peters, Berlin (DE); Martin Moeritz, Berlin (DE)

(73) Assignee: Klingenburg GmbH, Gladbeck (DE)

( * ) Notice: Subject to any disclaimer, the term of this patent is extended or adjusted under 35 U.S.C. 154(b) by 248 days.

(21) Appl. No.: 13/522,331

(22) PCT Filed: Nov. 23, 2010

(86) PCT No.: PCT/EP2010/007084

§ 371 (c)(1),
(2), (4) Date: Jul. 30, 2012

(87) PCT Pub. No.: WO2011/095188

PCT Pub. Date: Aug. 11, 2011

(65) Prior Publication Data

US 2012/0297979 A1 Nov. 29, 2012

(30) Foreign Application Priority Data

Feb. 5, 2010 (DE) ..... 10 2010 006 889

(51) Int. Cl.
*B01F 3/04* (2006.01)
*F24F 3/14* (2006.01)
*F24F 6/12* (2006.01)

(52) U.S. Cl.
CPC .... *F24F 3/14* (2013.01); *F24F 6/12* (2013.01)
USPC ..... 261/27; 261/95; 261/99; 261/101; 261/104

(58) Field of Classification Search
USPC ..... 261/26, 27, 94, 95, 97, 99, 101, 104, 261/116, 117
See application file for complete search history.

(56) References Cited

U.S. PATENT DOCUMENTS

| | | | | |
|---|---|---|---|---|
| 5,348,691 | A * | 9/1994 | McElroy et al. | 261/36.1 |
| 5,516,466 | A | 5/1996 | Schlesch | |
| 6,488,219 | B1 | 12/2002 | Herr | |
| 2005/0056313 | A1 | 3/2005 | Hagen | |

FOREIGN PATENT DOCUMENTS

| | | | |
|---|---|---|---|
| DE | 2005857 | A | 2/1970 |
| DE | 202007013484 | U | 3/2008 |
| JP | 7301442 | B | 11/1995 |

* cited by examiner

*Primary Examiner* — Robert A Hopkins
(74) *Attorney, Agent, or Firm* — Andrew Wilford

(57) ABSTRACT

The invention relates to a device for conditioning an air flow (2) comprising a humidifying apparatus (5) having humidifying elements(6), which are arranged in the air flow (2) to be humidified in the humidifying apparatus(5), can be loaded with pressurized water, and are made of a fluid-permeable, porous, preferably hydrophilic material. In order to increase the efficiency of the humidification of the air flow(2) in the humidifying apparatus (5), the humidifying elements(6) of the humidifying apparatus(5) loaded with pressurized water are designed with regard to the cross-section thereof in such a way that the peripheral surface or outer surface of the humidifying elements exposed to the air flow(2) to be humidified can be uniformly contacted by the air flow (2) to be humidified over the entire circumference of the humidifying elements.

24 Claims, 5 Drawing Sheets

Fig. 8
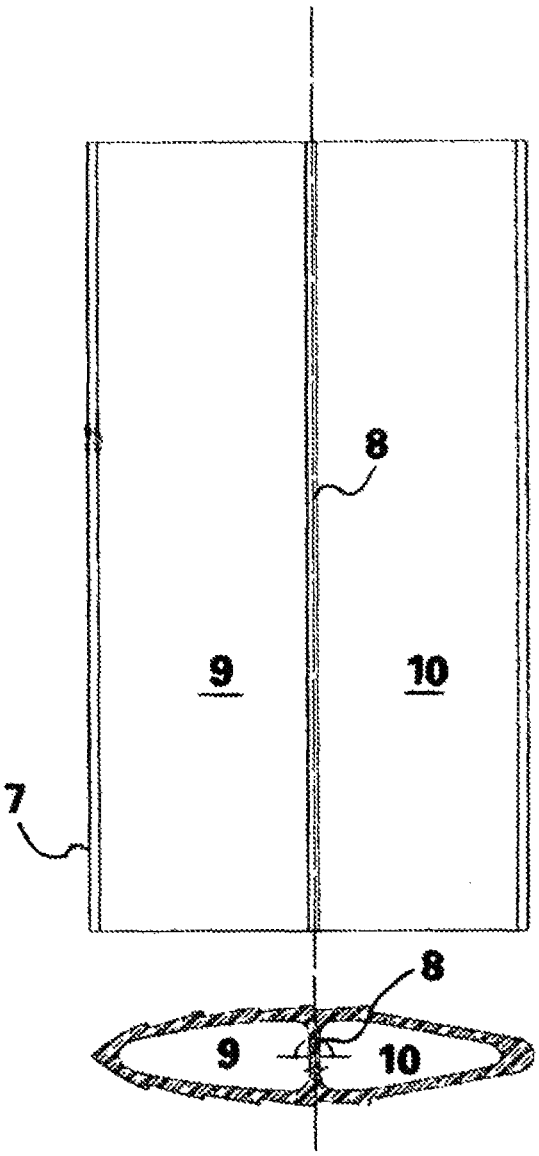
Fig. 9
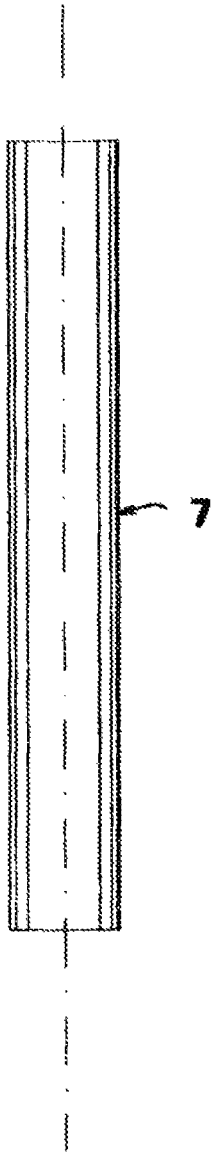
Fig. 10

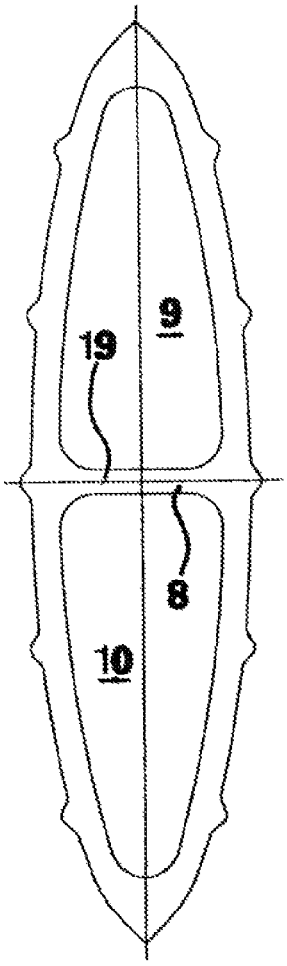
Fig.11
Fig.12
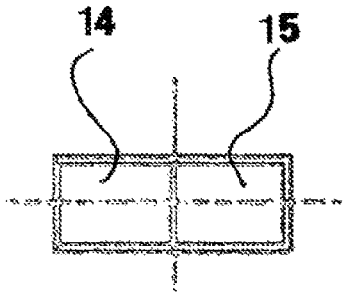
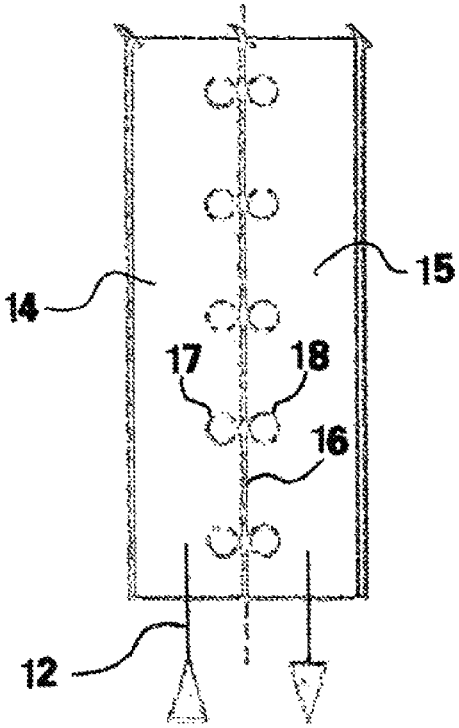
Fig.14
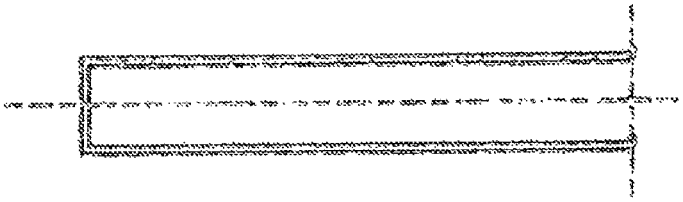
Fig.13

DEVICE FOR CONDITIONING AN AIR FLOW

CROSS REFERENCE TO RELATED APPLICATIONS

This application is the US-national stage of PCT application PCT/EP2010/007084 filed 23 Nov. 2010, published 11 Aug. 2011 as WO2011/095188, and claiming the priority of German Patent application 102010006889.6 itself filed 5 Feb. 2010.

FIELD OF THE INVENTION

The invention relates to an apparatus for conditioning an airstream with a humidifier with humidifying elements that are in the airstream to be humidified with the humidifier, that can be supplied with pressurized water, and that are formed by a fluid-permeable, porous, preferably hydrophilic material.

BACKGROUND OF THE INVENTION

Apparatuses of this type for conditioning an airstream are described, for example, in EP 1 519 118 and EP 1 710 516. Humidifying the airstream can be ensured by the humidifiers without dripping water or condensation water occurring to a larger extent.

OBJECT OF THE INVENTION

Starting from the prior art described above, the object of the invention is to further develop this type of apparatus for conditioning an airstream described above such that the efficiency of humidifying the airstream is increased and the space requirement for the apparatus, in particular the space requirement for the humidifier of the it can be substantially reduced.

SUMMARY OF THE INVENTION

This object is attained according to the invention in that the humidifying elements of the humidifier supplied with pressurized water are designed with respect to their cross section such that their outer surfaces exposed to the airstream to be humidified can be contacted uniformly over their entire outer surface by the airstream to be humidified.

According to the invention it is ensured over the entire outer surface of the humidifying elements that the transfer of the humidity into the airstream to be humidified takes place in an optimal and uniform manner. On the one hand the efficiency of the humidifier and thus the efficiency of the entire apparatus for conditioning the airstream is increased, on the other hand, the size in particular of the humidifier can be considerably reduced with the same output manifold. This opens up possibilities of subsequently retrofitting apparatuses designed according to the invention for conditioning an airstream into existing air-conditioning systems without major constructional adjustments etc. being necessary.

If the humidifying elements of the humidifier are mounted transversely to the flow direction of the airstream to be humidified in the humidifier, uniform conditions can be assumed in the transfer of thermal energy and/or of humidity into the airstream.

The humidifying elements of the apparatus according to the invention for conditioning the airstream can advantageously be designed as humidifying pipes whose walls are made of the fluid-permeable, porous, preferably hydrophilic material and the pressurized water can flow through the free pipe cross section and from there can enter into the pipe wall.

The cross section of the humidifying elements or the pipe cross section of the humidifying pipes is designed such that the humidifying elements or the humidifying pipes have a flow resistance that is as low as possible in the flow direction of the airstream to be humidified.

The cross section of the humidifying elements or the humidifying pipes can be a drop-shaped with the tip of the drop or the region of greatest curvature of the drop cross section pointing in the flow direction of the airstream to be humidified; alternatively, it is possible for the cross section of the humidifying elements or the humidifying pipes to be a wing cross section; according to a further alternative, the cross section of the humidifying elements or the humidifying pipes tapers in the flow direction of the airstream to be humidified as well as opposite to the flow direction of the airstream to be humidified; moreover, an oval cross section of the humidifying elements or the humidifying pipes is possible, with the longitudinal axis of the oval oriented in the flow direction of the airstream to be humidified.

All of the designs of the cross section or of the pipe cross section explicitly given above ensure that the outer surfaces of the humidifying elements or the humidifying pipes are contacted as uniformly as possible by the airstream to be humidified, with the result that a uniform transfer of the water or the humidity from the outer surfaces of the humidifying elements or humidifying pipes into the airstream to be humidified is realized.

If the outer surfaces exposed to the airstream to be humidified of the humidifying elements or humidifying pipes composed of a fluid-permeable, porous material, have a two-dimensional, for example fluted, ribbed and/or rough structure, by means of which the outer surfaces exposed to the airstream to be humidified are enlarged, the efficiency with which water or humidity is transferred from the humidifying elements or the humidifying pipes into the airstream to be humidified is further increased. The output manifold can be increased hereby with predetermined size; alternatively, it is possible with the same output manifold to reduce the size of the apparatus according to the invention for conditioning the airstream.

The porous and fluid-permeable, preferably hydrophilic humidifying elements or humidifying pipes advantageously can be made of ceramic, sintered metal or plastic. The requirement profile for the humidifying elements or humidifying pipes is decisive for the selection of the material, which requirement profile is determined by the type of use of the apparatus for conditioning an airstream.

In a further advantageous embodiment of the apparatus according to the invention for conditioning an airstream, the permeability for water of the humidifying elements or humidifying pipes can be adjusted by coating the humidifying elements or the humidifying pipes, this coating being a selectively permeable membrane. This membrane can have a high wet strength. With a coating of this type, a durably reliable operation of the apparatus according to the invention is ensured.

If the coating is a polymer material, for example a suitable Nexar® polymer by Kraton, it can be adjusted as desired with respect to its permeability for water due to the properties of such polymer materials.

With these advantageous further developments of the apparatus according to the invention, the materials forming the humidifying elements or humidifying pipes are ultimately no longer decisive for the exact adjustment of the permeability of the humidifying elements or humidifying pipes for water.

This precise adjustment or fine tuning of the permeability of water is achieved by the coating of the polymer material that can be adjusted as desired in this respect, so that the desired porosities of the humidifying elements or humidifying pipes are exactly reproducible and precisely adjustable. The expenditure necessary for this with this embodiment of the humidifying elements or humidifying pipes of the apparatus according to the invention is considerably reduced. With this embodiment of the humidifying elements or humidifying pipes, these are then composed of a substrate that can be composed, for example, of the porous materials permeable to water previously described, as well as of the coating of the polymer material described above. The substrate is designed such that water can penetrate through it to the coating, where, however, the passage of the water to the outer surface of the humidifying elements or humidifying pipes can take place in the desired manner due to the easily adjustable properties of the coating. As already mentioned, these properties of the humidifying elements or the humidifying pipes can be achieved by the polymer coating described above with much lower technical/economic expenditure.

In an advantageous embodiment of the apparatus for conditioning the airstream according to the invention, the pressurization of the water transferred to the outer surfaces of the fluid-permeable porous humidifying elements or humidifying pipes, taking into consideration the permeability of the humidifying elements or humidifying pipes and the temperature of the airstream to be humidified, is adjustable such that the pressurized water at the moment of transfer from the outer surfaces of the humidifying elements or humidifying pipes into the airstream to be humidified is converted into vapor. This ensures that dripping water, trickling water or condensation water does not occur, with the result that complex measures for collecting or returning water of this type can be omitted.

With certain requirement profiles for the humidifier of the apparatus for conditioning the airstream, it is advantageous if thermal energy can also be transferred to the airstream through the humidifying elements or humidifying pipes.

To increase the ability to control and regulate the transfer of water into the airstream to be humidified, it is advantageous if the material of the humidifying elements or the humidifying pipes can be temperature-controlled. This be effected, for example, by heating wires or comparable components.

Furthermore, to further increase the efficiency of the transfer of water into the airstream to be humidified, a temperature regulator can be provided by means of which the temperature of the water introduced into the humidifying elements or humidifying pipes can be adjusted. It is furthermore possible by the temperature control of the water to transfer thermal energy from the water by or via the humidifying elements or humidifying pipes into the airstream, i.e. to cool or heat the airstream.

With a particularly advantageous embodiment of the is apparatus for conditioning the airstream according to the invention, an adjustment means is provided by means of which the pressure and/or the flow rate of the water introduced into the humidifying elements or humidifying pipes can be adjusted.

If the cross section of the humidifying pipes is divided into two flow passages, the two flow passages are connected to one another at a free outer end of the humidifying pipe, and the one flow passage of the humidifying pipe is connected at a proximal inner end of the humidifying pipe opposite the free end to an input manifold of the humidifier and the other flow passage of the humidifying pipe is connected at the proximal inner end of the humidifying pipe opposite the free end to an output manifold of the humidifier, it is possible due to the embodiment of the humidifying pipe with a cross section divided into two flow passages to design this humidifying pipe in a more mechanically stable manner than in the prior art.

Another advantageous further development of the apparatus according to the invention results when a partition is provided between the two flow passages of the humidifying pipe of the same material as the rest of the humidifying pipe.

A substantial reduction of the flow resistance of the apparatus according to the invention on the airstream flowing past can be achieved if the cross section of the humidifying pipes has the shape of a flattened elongated oval whose longitudinal axis is aligned approximately parallel to the flow direction of the airstream.

The flow resistance of the apparatus according to the invention can be further reduced if the cross section of the humidifying pipe is symmetrical to the transverse axis of the oval.

Advantageously, the transverse axis of the elongated oval can lie in the partition, which is beneficial for the mechanical stability of the humidifying pipe.

A particularly compact and mechanically stable design of the apparatus according to the invention can be achieved if the input manifold and the output manifold extend parallel to each other and a partition between the input manifold and the output manifold is aligned with the partitions of the humidifying pipes. The transition from the input manifold into the respective humidifying pipe as well as the transition or port from the humidifying pipe into the output manifold can be adapted to the flow cross section of the respective flow passage of the humidifying pipe.

An embodiment of the apparatus according to the invention that can be adapted to a variety of requirement profiles with low technical/structural expenditure can be achieved if the humidifying pipes are each made of at least one length module part with the partition between the two flow passages and an end cap that has no partition and is mounted at the free outer end of the humidifying pipe. Since the length of the input manifold and of the output manifold can be determined freely and the length of the humidifying pipes likewise can be selected as desired, the apparatus according to the invention can be adapted easily to the flow cross section of the airstream to be impinged.

Advantageously, the humidifying pipes can be locked and attached to the input manifold and to the output manifold.

The input manifold and the output manifold are advantageously composed of a microbially inert material, for example aluminum, stainless steel or a suitable plastic.

With a method of conditioning an air flow according to the invention, thermal energy is transferred into the airstream and the airstream is humidified by humidifying elements or humidifying pipes in that water is fed under pressure into the humidifying elements or humidifying pipes and transferred through the humidifying elements or pipe walls of the humidifying pipes, composed of a fluid-permeable porous, preferably hydrophilic material, into the airstream. To increase the efficiency of this method, the water is pressurized, taking into consideration the permeability or the porosity of the material of the humidifying elements or humidifying pipes and the temperature of the airstream to be humidified and optionally further parameters, such that in the moment of transfer from the outer surfaces of the humidifying elements or humidifying pipes into the airstream to be humidified, it is converted into vapor.

Advantageously, with this method the water temperature and/or the relative air humidity of the airstream to be humidified and/or the flow rate of the airstream to be humidified and/or the optionally variable material temperature of the humidifying elements or humidifying pipes can be taken into consideration as further parameters.

The efficiency of the method of conditioning the airstream according to the invention can be increased if the material of the humidifying elements or humidifying pipes is temperature-controlled and/or the flow rate of the water introduced into the humidifying elements or the humidifying pipes is adjusted. The corresponding temperature control or flow rate adjustment is naturally carried out taking into consideration the parameters also to be taken into account with the pressurization of the water.

BRIEF DESCRIPTION OF THE DRAWING

The invention is explained in more detail below based on embodiments with reference to the drawing. Therein:

FIGS. 8 through 10 are side, front, and cross-sectional views of a length module part of a humidifying pipe of the apparatus according to the invention;

FIG. 11 is a cross section through a further embodiment of a length module part of a humidifying pipe of the apparatus according to the invention;

FIGS. 12 through 14 are front, side, and plan views of an input manifold and an output manifold of the apparatus according to the invention.

SPECIFIC DESCRIPTION OF THE INVENTION

Figure 1:
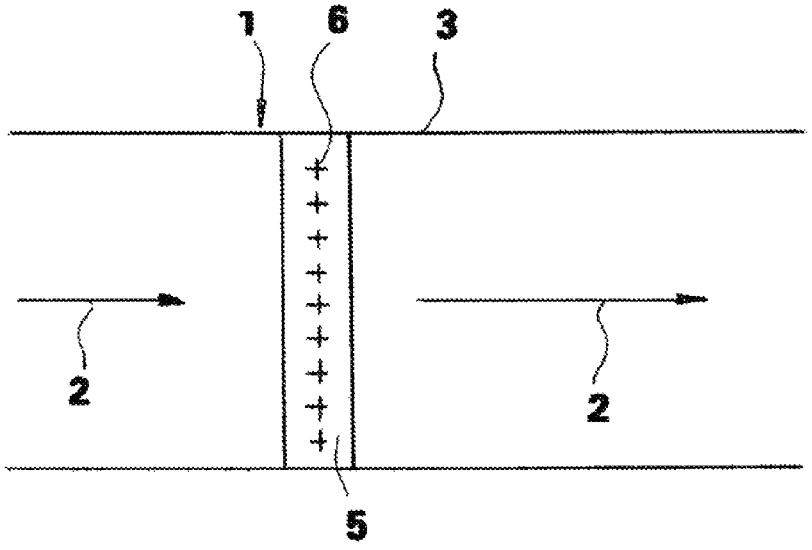
FIG. 1 is a schematic diagram of an embodiment of an is apparatus for conditioning an airstream according to the invention.

An embodiment of an apparatus 1 for conditioning an airstream 2 according to the invention shown schematically in FIG. 1 is mounted in a housing 3 only shown in FIG. 1 of an air conditioning system, not otherwise shown. A humidifier 5 is part of the apparatus 1 for conditioning the airstream 2.

The humidifier 5 is used to increase the humidity of the airstream 2. To this end the humidifier 5 in the illustrated embodiments described below has a plurality of humidifying pipes 6 that extend transversely to the flow direction of the airstream 2 flowing through the humidifier 5 and into which pressurized water is introduced.

The walls of the humidifying pipes 6 are made of a hydrophilic, fluid-permeable and porous material. The pressurized water introduced into the humidifying pipes 6 penetrates the walls of the humidifying pipes 6 and is absorbed on the outer surfaces of the humidifying pipes 6 by the airstream 2 flowing through the humidifier 5.

The humidifying pipes 6 of the humidifier 5 have a cross section that ensures that the outer surfaces of the humidifying pipes 6 that are exposed to the airstream 2 to be humidified are contacted uniformly by the airstream 2 to be humidified over the entire outer surface of the humidifying pipes 6.

Figure 2:
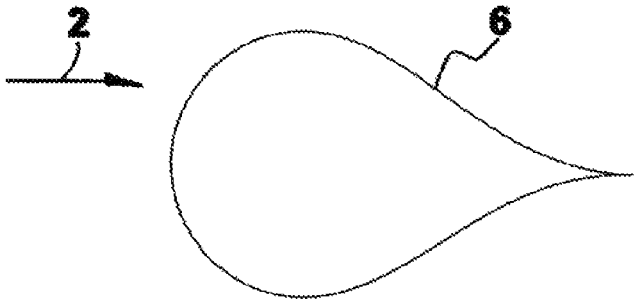
FIGS. 2 through 4 show embodiments of humidifying elements or humidifying pipes of a humidifier of the apparatus for conditioning an airstream according to the invention.
Figure 3:
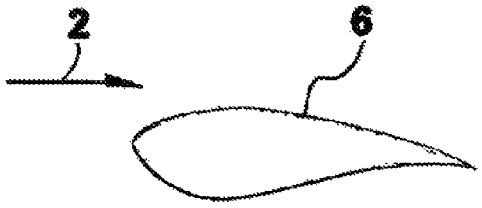
Figure 4:
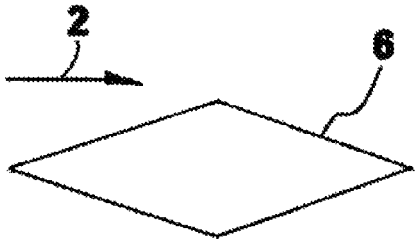

To this end, the pipe cross section or flow cross section of the humidifying pipes, as shown by way of example in FIGS. 2 through 4, can be a drop-shaped, wing-shaped, or taper in as well as against the flow direction of the airstream 2 to be humidified. In any case, it is taken into consideration in the design of the pipe cross section of the humidifying pipes 6 that the humidifying pipes 6 in the flow direction of the airstream 2 to be humidified should have a flow resistance that is minimized as far as possible.

In the case of a drop-shaped cross section of the humidifying pipes 6, as shown in FIG. 2, the pipe cross section with the region of greatest curvature or with the tip of the drop points in the flow direction of the airstream 2 to be humidified. Humidifying pipes 6 formed with a wing cross sections are also oriented in a corresponding manner as shown by FIG. 3. In the case of the pipe cross section of the humidifying pipes 6 shown in FIG.

4, the two points are directed in the flow direction of the airstream to be humidified or exactly opposite to the flow direction of the airstream 2 to be humidified.

Figure 5:
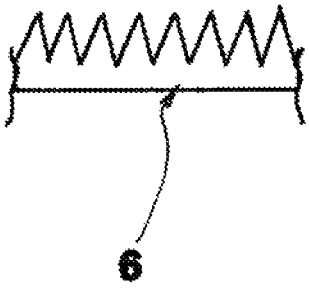
FIGS. 5 through 7 show embodiments for the design of the outer surface or circumferential surface of the humidifying elements or humidifying pipes of the apparatus for conditioning an airstream according to the invention.
Figure 6:
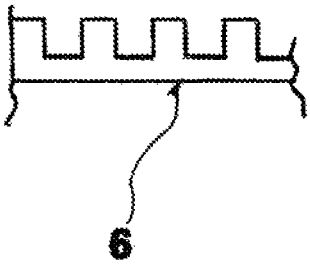
Figure 7:
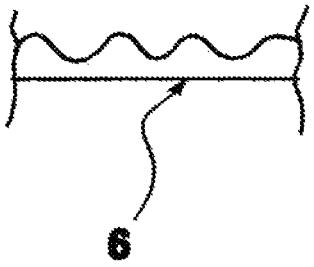

The outer surfaces of the humidifying pipes 6 can have the two-dimensional surface structures shown in FIGS. 5, 6 and 7, by means of which these outer surfaces of the humidifying pipes 6 exposed to the airstream 2 to be humidified are enlarged. With a limited given space available for the humidifier 5, the quantity of the water to be transferred into the airstream 2 to be humidified can hereby be increased.

The surface structures shown by way of example in FIGS. 5 through 7 have no connection to the porosity of the hydrophilic, porous and fluid-permeable material forming the walls of the humidifying pipes 6. The irregularities on the outer surfaces of the humidifying pipes 6 resulting from this porosity are negligibly small compared to the structures of the outer surfaces shown by way of example in FIGS. 5 through 7.

For example, a suitable ceramic material, a sintered metal material or a suitable plastic is possible as a material for the hydrophilic, fluid-permeable and porous humidifying pipes 6.

The water introduced into the humidifying pipes 6 of the humidifier, which is to be transferred into the airstream 2 to be humidified, as already mentioned, is introduced into the humidifying pipes 6 under superatmospheric pressure. To this end, for example, a pump not shown in the figures is used. This pump is controlled with or without feedback by a controller such that if the porosity of the material forming the humidifying pipes 6 is taken into consideration and if the temperature of the airstream 2 to be humidified is taken into consideration, at the moment of the transfer from the outer surfaces of the humidifying pipes 6 into the airstream 2 to be humidified, the pressurized water is converted into vapor. This reliably prevents dripping water, condensation water or the like from occurring in the humidifier 5.

In addition, with the control with or without feedback of the pump, the water temperature and/or the relative air humidity of the airstream 2 to be humidified and/or the flow rate of the airstream 2 to be humidified and/or the optionally variable material temperature of the humidifying pipes 6 can be taken into consideration.

The pore size of the material forming the humidifying pipes 6 is preferably less than 20 μm, particularly advantageously less than 10 μm.

The humidifier 5 can be designed such that it can also be used to transfer thermal energy to the airstream to be humidified.

It can be possible to control the temperature of the material of the humidifying pipes 6, where to this end, for example heating wires can be used that can transfer heat to the material of the humidifying pipes in a manner than can be exactly controlled or regulated.

Furthermore, the apparatus for conditioning the airstream can have a temperature regulator by means of which the temperature of the water introduced into the humidifying pipes 6 can be adjusted as desired depending on the requirement profile. Accordingly, an adjustable pump, for example, can be part of the apparatus for conditioning the airstream 2, by means of which the pressure and the flow rate of the water introduced into the humidifying pipes is or are adjusted depending on requirements.

In the case of the embodiments of the apparatus 1 according to the invention shown in FIGS. 8 through 15 and described in detail below, this is used to act on the airstream or airstream 2 with humidity.

At this point it should be noted that the apparatus 1 according to the invention is basically also suitable for acting on the airstream with thermal energy in the form of heat or cold. Furthermore, embodiments of the apparatus 1 are naturally possible in which the airstream can be acted on with thermal energy as well as also with humidity.

Figure 15:
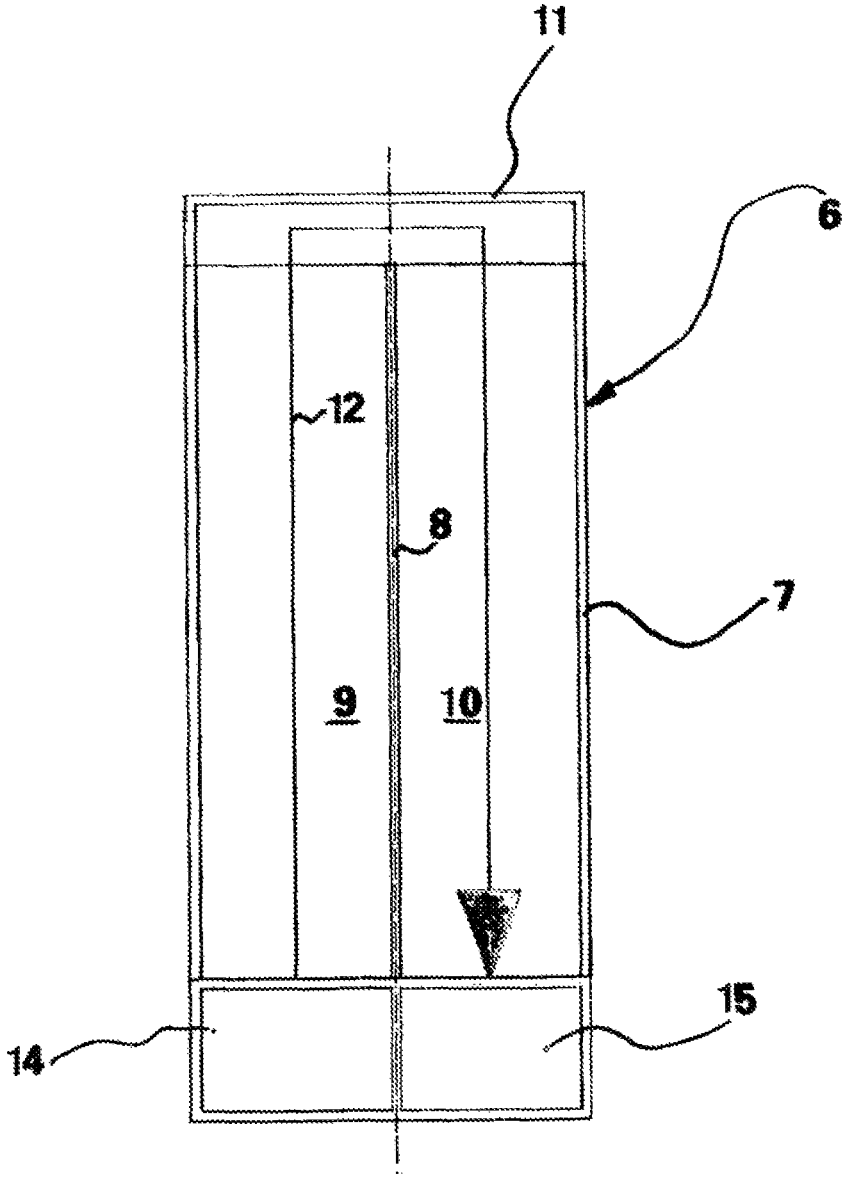
FIG. 15 is a schematic diagram of a humidifying pipe of the apparatus according to the invention connected to the output manifold and the input manifold.

The humidifying apparatus 1 includes a plurality of length module parts 7 that form the essential component of a humidifying pipe 6, as shown in FIG. 15. The length module part 6 of the humidifying pipe 6, as FIGS. 8 through 10 show, has an elongated oval shape in cross section. The length module part 7 of the humidifying pipe 6 within its pipe cross section, as FIGS. 8 through 10 show, has a partition 8 that, as shown in FIG. 10 is approximately central in the longitudinal direction of the elongated oval cross section. The cross section of the humidifying pipe 6 is divided into two flow passages 9 and 10 by the partition 8, which flow passages have approximately the same flow cross section. The elongated oval cross-sectional shape of the humidifying pipe 6 or of the length module part 7 of it means that the outer surface of the humidifying pipe 6 comes into contact in a highly uniform manner with the airstream 2 flowing past the apparatus 1. This is also assisted by the two-dimensional structuring of the outer surface, which is shown best by FIGS. 10 and 11 that show a further embodiment of the length module part 7.

The humidifying pipe 6—depending on the requirement profile—can have several elongated module parts 7 shown in FIGS. 8 through 10 and 11.

The humidifying pipes 6 of the apparatus 1 can be oriented in a desired manner with respect to the airstream 2, however, it is frequently advantageous if these humidifying pipes 6 are oriented with their longitudinal direction transverse to the airstream 2.

As shown in particular by FIG. 15, the humidifying pipe 6, in this illustrated embodiment with only one length module part 7, is closed on its upper end in FIG. 15 by an end cap 11. The end cap 11 has the same cross section as the elongated module part 7, but does not have the partition 8 provided in the length module part 7, so that a humidifying medium 12 that flows through the humidifying pipe 6, at the upper end of the humidifying pipe 6 in FIG. 15 can flow out of the flow passage 9 on the left in FIG. 15 into the flow passage 10 on the right in FIG. 15 that guides the humidifying medium 12 back to the end of the humidifying pipe 6 at a spacing from the end cap, as shown in FIG. 15 by the arrow bent twice at right angles or the flow of the humidifying medium 12.

The wall of the humidifying pipe 6 is permeable to the humidifying medium 12 in the humidifying pipe 6. The humidifying medium 12 passes through the wall of the humidifying pipe 6 and at the outer surface of the humidifying pipe 6 comes into contact with the airstream 2 flowing through a fluid conduit, so the airstream absorbs the humidifying medium 12.

With the symmetrical embodiment shown in FIG. 11 of the cross section of the length module part 7 of the humidifying pipe 6, uniformity of the transfer of the humidifying medium 12 into the airstream 2 is achieved that is somewhat higher than in the case of the not exactly symmetrical cross section shown in FIG. 10.

The transverse axis 19 of the elongated oval symmetrical cross section lies in the partition 8 in the embodiment shown.

To supply the humidifying medium 12 to the humidifying pipes 6 of the apparatus 1, the apparatus 1 is provided with an input manifold 14 and an output manifold 15 as shown in FIGS. 12 through 14. The input manifold 14 and the output manifold 15 bear against one another with walls to lie against each other with a partition 16 formed between the input manifold 14 and the output manifold 15. From the plan view of the unit of the input manifold 14 and the output manifold 15 shown in FIG. 14 it is clear that the humidifying medium 12, as shown by the arrow directed upward, enters the input manifold 14. In the illustrated embodiment shown, the input manifold 14 is provided with uniformly spaced ports 17 through which the humidifying medium 12 can pass from the input manifold 14 into the humidifying pipes 6. In the case of the view of FIG. 14, these ports 17 are shown circular for reasons of simplicity. However, the opening of the ports 17 can have a cross section that is adapted to the cross section of the flow passages 9 of the humidifying pipes 6. The humidifying medium 12 thus passes from the input manifolds 14 into the flow passages 9 of the humidifying pipes 6, then in the region of the end caps 11 of the humidifying pipes 6 into the flow passages 10 of the humidifying pipes 6 and then out of the flow passages 10 of the humidifying pipes 6 through the ports 18 shown in FIG. 14 into the output manifold 15, from which surplus humidifying medium 12 can exit, as shown by the arrow directed downward. Also in the case of the output manifold 15, in FIG. 14 the ports 18 are drawn in a circular manner, but can have the cross section of the flow passages 10 of the humidifying pipes 6.

A combination of FIGS. 14 and 15 shows that the partitions 8 of the humidifying pipes 6 are aligned with the partition 16 between the input manifold 14 and the output manifold 15.

The apparatus 1 for humidifying airstream 2 can be produced in any desired dimensions, which dimensions of the input manifold 14 and of the output manifold 15 can be selected quasi freely and the number as well as the lengths of the humidifying pipes 6 are as desired due to the possibility of forming these humidifying pipes 6 by a desired number of elongated module parts 7 and an end cap 11.

The partition 8 of the length module part 7 can be is produced from the same material as the rest of the length module part 7.

In the illustrated embodiment shown the outer surface of the humidifying pipe 6 is structured in a two-dimensional manner and provided with ribs or projections, as shown by FIGS. 10 and 11.

The humidifying pipes 6 can be locked and attached to the input manifold 14 and to the output manifold 15 by suitable connection means.

The input manifold 14 and the output manifold 15 of the apparatus 1 described above can be a microbially inert material, for example of aluminum, stainless steel or a correspondingly designed plastic.

In order that the humidifying elements or humidifying pipes can be produced precisely and reproduced exactly with respect to their permeability for water, it is possible that the humidifying elements or humidifying pipes 6 have a base or substrate that can be composed of one of the materials mentioned above that are designed to be permeable to water, for example, porous. The exact adjustment of the water permeability, however, is not carried out by the material selection for the base body or substrate, but by a coating that is applied to this base body or substrate. This coating is made of a polymer material that can be adjusted as desired with respect to its permeability for water with very low expenditure. This polymer material can be, for example a suitable Nexar® polymer from Kraton.

A polymer material of this type can be a non-porous, selectively permeable membrane with a high wet strength. The coating containing this polymer material then controls the passage of water or humidity to the outer surface of the humidifying elements or humidifying pipes 6.

As already mentioned, the base body or substrate of the humidifying elements or humidifying pipes 6 in this embodiment is designed such that the water can penetrate through it to the coating described above, where however due to the properties of this coating that can be easily adjusted the passage of the water to the outer surface of the humidifying element or humidifying pipe 6 takes place in the desired, finely adjustable manner.

The invention claimed is:

1. In an apparatus for conditioning an airstream with a humidifier having humidifying elements that are in the airstream to be humidified in the humidifier, that can be supplied with pressurized water, that are formed of a fluid-permeable, porous, hydrophilic material, and that are designed with respect to their cross section such that their outer surface exposed to the airstream to be humidified can be contacted uniformly over the entire outer surface by the airstream to be humidified, the improvement wherein the cross section of the humidifying elements is drop-shaped and points with the tip of the drop or the region of its greatest curvature in a flow direction of the airstream to be humidified, is a wing cross section, tapers in the flow direction of the airstream to be humidified as well as opposite to the flow direction of the airstream to be humidified, or is oval and with a longitudinal axis of the oval parallel to the flow direction of the airstream to be humidified.

2. The apparatus for conditioning an airstream according to claim 1, wherein the humidifying elements of the humidifier extend transversely to the flow direction of the airstream to be humidified in the humidifier.

3. The apparatus for conditioning an airstream according to claim 1, wherein the humidifying elements are humidifying pipes.

4. The apparatus for conditioning an airstream according to claim 1, wherein the fluid- permeable, porous, hydrophilic humidifying elements are a ceramic, sintered metal or plastic.

5. The apparatus for conditioning an airstream according to claim 1, wherein the permeability for water of the humidifying elements can be adjusted by a coating of the material of the humidifying elements, the coating being a selectively permeable membrane.

6. The apparatus for conditioning an airstream according to claim 5, wherein the coating is a polymer material that is adjustable as desired with respect to its permeability for water and has a high wet strength.

7. The apparatus for conditioning an airstream according to claim 1, wherein the pressurization of the water transferred to the outer surfaces of the fluid-permeable porous humidifying elements, taking into consideration the permeability of the humidifying elements and the temperature of the airstream to be humidified, is adjustable such that the pressurized water at the moment of transfer from the outer surfaces of the humidifying elements into the airstream to be humidified is converted into vapor.

8. The apparatus for conditioning an airstream according to claim 1, wherein thermal energy can be transferred to the airstream through the humidifying elements.

9. The apparatus for conditioning an airstream according to claim 1, wherein the material of the humidifying elements or the humidifying pipes can be temperature-controlled.

10. The apparatus for conditioning an airstream according to claim 1, with a temperature regulator by means of which the temperature of the water introduced into the humidifying elements can be adjusted.

11. The apparatus for conditioning an airstream according to claim 1, with an adjustment means by means of which the pressure or the flow rate of the water introduced into the humidifying elements can be adjusted.

12. In an apparatus for conditioning an airstream with a humidifier having humidifying elements that are in the airstream to be humidified in the humidifier, that can be supplied with pressurized water, that are formed of a fluid-permeable, porous, hydrophilic material, and that are designed with respect to their cross section such that their outer surface exposed to the airstream to be humidified can be contacted uniformly over the entire outer surface by the airstream to be humidified, the improvement wherein the outer surfaces exposed to the airstream to be humidified of the humidifying elements composed of a fluid-permeable, porous, hydrophilic material, have a two-dimensional, fluted, ribbed or rough structure, by means of which the outer surfaces exposed to the airstream to be humidified are enlarged.

13. In an apparatus for conditioning an airstream with a humidifier having humidifying pipes that are in the airstream to be humidified in the humidifier, that can be supplied with pressurized water, that are formed of a fluid-permeable, porous, hydrophilic material, and that are designed with respect to their cross section such that their outer surface exposed to the airstream to be humidified can be contacted uniformly over the entire outer surface by the airstream to be humidified, the improvement wherein the cross section of the humidifying pipes is divided into two flow passages that are connected to one another at a free end of each of the humidifying pipes, and one of the flow passages of each of the humidifying pipes is connected at a proximal end of the respective humidifying pipe opposite the free end to an input manifold of the humidifier and the other flow passage of each of the humidifying pipes is connected at the proximal end of the respective humidifying pipe opposite the free end to an output manifold of the humidifier.

14. The apparatus for conditioning an airstream according to claim 13, wherein a partition is formed between the two flow passages of the humidifying pipe of the same material as the humidifying pipe.

15. The apparatus for conditioning an airstream according to claim 13, wherein a cross section of the humidifying pipe has the shape of a flattened elongated oval.

16. The apparatus for conditioning an airstream according to claim 15, wherein the cross section of the humidifying pipe is symmetrical to a transverse axis of the oval.

17. The apparatus for conditioning an airstream according to claim 16, wherein the transverse axis of the oval lies in the partition.

18. The apparatus for conditioning an airstream according to claim 13, wherein the input manifold and the output manifold bear against one another and a partition between the input manifold and the output manifold is aligned with the partitions of the humidifying pipes.

19. The apparatus for conditioning an airstream according to claim 13, wherein the humidifying pipes are respectively formed of at least one length module part with the partition between the two flow passages and an end cap that is spaced from a partition and is mounted at a free end of the humidifying pipe.

20. The apparatus for conditioning an airstream according to claim 13, wherein the humidifying pipes can be locked and attached to the input manifold and to the output manifold.

21. The apparatus for conditioning an airstream according to claim 13, wherein the input manifold and the output manifold are made of a microbially inert material.

22. A method of conditioning an airstream, wherein the airstream is humidified by humidifying elements, the method comprising the steps of:

constituting the humidifying elements of a fluid-permeable and hydrophilic material;

supplying water under pressure to the humidifying elements and thereby transferring the water through the humidifying elements;

pressurizing the water taking into consideration the permeability or the porosity of the material of the humidifying elements and the temperature of the airstream to be humidified such that, on transfer from outer surfaces of the humidifying elements into the airstream to be humidified, it is converted into vapor; and providing the elements with cross sections that are drop-shaped and points with the tip of the drop or the region of its greatest curvature in a flow direction of the airstream to be humidified, is a wing cross section, tapers in the flow direction of the airstream to be humidified as well as opposite to the flow direction of the airstream to be humidified, or is oval and with a longitudinal axis of the oval parallel to the flow direction of the airstream to be humidified.

23. The method of conditioning an airstream according to claim 22, wherein in the pressurization of the water, the water temperature or the relative air humidity of the airstream to be humidified or the flow rate of the airstream to be humidified or the optionally variable material temperature of the humidifying elements is or are taken into consideration as further parameters.

24. The method of conditioning an airstream according to claim 22, wherein the material of the humidifying elements or the humidifying pipes is temperature-controlled or the flow rate of the water introduced into the humidifying elements or the humidifying pipes is adjusted.

* * * * *